US007837508B1

(12) United States Patent
Switzer

(10) Patent No.: US 7,837,508 B1
(45) Date of Patent: Nov. 23, 2010

(54) RECESSED LIGHT EXTENSION SOCKET

(76) Inventor: Calvin T. Switzer, 3243 Countryclub Parkway, Castle Rock, CO (US) 80108

( * ) Notice: Subject to any disclaimer, the term of this patent is extended or adjusted under 35 U.S.C. 154(b) by 328 days.

(21) Appl. No.: 12/061,729

(22) Filed: Apr. 3, 2008

Related U.S. Application Data

(60) Continuation-in-part of application No. 11/613,484, filed on Dec. 20, 2006, now Pat. No. 7,377,817, which is a division of application No. 11/056,178, filed on Feb. 10, 2005, now Pat. No. 7,153,167.

(51) Int. Cl.
*H01R 25/00* (2006.01)

(52) U.S. Cl. ..... 439/642; 362/147

(58) Field of Classification Search ..... 362/147, 362/391, 403–408, 650; 439/642–644
See application file for complete search history.

(56) References Cited

U.S. PATENT DOCUMENTS

| | | | | |
|---|---|---|---|---|
| 394,680 | A | | 12/1888 | Dawes |
| 684,264 | A | | 10/1901 | Kemmerer |
| 806,516 | A | | 12/1905 | Berry |
| 866,473 | A | | 9/1907 | Keffe et al. |
| 1,263,783 | A | | 4/1918 | Maier |
| 1,297,211 | A | | 3/1919 | Magness |
| 1,348,949 | A | | 8/1920 | Johanssen |
| 1,882,312 | A | * | 10/1932 | Aspinwall ..... 248/343 |
| 1,934,624 | A | | 11/1933 | Guth |
| 2,115,898 | A | | 5/1938 | Zagora |
| 2,217,533 | A | | 10/1940 | Wolarsky |
| 2,280,505 | A | * | 4/1942 | Beck ..... 362/291 |
| 2,419,018 | A | | 4/1947 | Gudie |
| 2,446,736 | A | | 8/1948 | Biller |
| 2,753,445 | A | | 7/1956 | Thomas et al. |
| 2,767,953 | A | | 10/1956 | Wolar |
| 3,506,232 | A | * | 4/1970 | Wolar et al. ..... 248/320 |
| 4,039,821 | A | | 8/1977 | Greene et al. |
| 4,223,179 | A | | 9/1980 | Lusk et al. |
| 4,232,361 | A | | 11/1980 | Kelsall |
| 4,327,402 | A | * | 4/1982 | Aubrey ..... 362/288 |
| 4,407,560 | A | | 10/1983 | Williams |
| 4,595,969 | A | | 6/1986 | McNair |
| D298,657 | S | | 11/1988 | Flores |
| 4,783,726 | A | | 11/1988 | Wang |
| 4,952,157 | A | | 8/1990 | Hudson et al. |

(Continued)

OTHER PUBLICATIONS

Hampton Bay, Track Light Accessory, A25 "Recessed to Track Converter" 2 pages.

(Continued)

*Primary Examiner*—Thanh-Tam T Le
(74) *Attorney, Agent, or Firm*—Rick Martin; Patent Law Office of Rick Martin, P.C.

(57) ABSTRACT

A standard ceiling recessed lighting fixture can be modified to a low-slung AC or DC light fixture with a screw-in extension rod. The extension rod with bulb can be used to light a restaurant table or a pool table or a workbench and the like. A series of extension rods can be screwed together for a desired length. Rigid and flexible extension rods are disclosed. A dome light and ceiling fan mounting bracket for a recessed lighting fixture are disclosed.

9 Claims, 19 Drawing Sheets

U.S. PATENT DOCUMENTS

| | | | | |
|---|---|---|---|---|
| 5,257,172 | A | 10/1993 | Erickson | |
| 5,317,493 | A | 5/1994 | Muller et al. | |
| 6,113,433 | A | 9/2000 | Al-Turki | |
| 6,305,974 | B1 | 10/2001 | Tseng | |
| 6,409,365 | B1 | 6/2002 | Lin | |
| 6,474,829 | B2 | 11/2002 | Clodfelter | |
| 6,523,970 | B1 | 2/2003 | Scales, III | |
| 6,536,927 | B1 * | 3/2003 | Lawnicki | 362/448 |
| 6,679,620 | B2 | 1/2004 | Patz et al. | |
| 6,997,740 | B2 | 2/2006 | Kerr | |
| 7,036,954 | B1 * | 5/2006 | Cordle et al. | 362/161 |
| 7,153,167 | B1 | 12/2006 | Switzer | |
| 7,311,425 | B2 | 12/2007 | Jervey, III | |
| 7,329,023 | B2 * | 2/2008 | Mast | 362/147 |
| 2003/0161149 | A1 | 8/2003 | Eaton, Jr. | |
| 2003/0235049 | A1 | 12/2003 | Wu | |
| 2007/0014118 | A1 | 1/2007 | Shourds | |

OTHER PUBLICATIONS

U.S. Appl. No. 11/613,484, filed Dec. 20, 2006; Inventor: Calvin Switzer.

USPTO Office Action dated Jun. 8, 2010, U.S. Appl. No. 12/211,508, filed Sep. 16, 2008, Applicant, Calvin T. Switzer.

* cited by examiner

Fig. 1
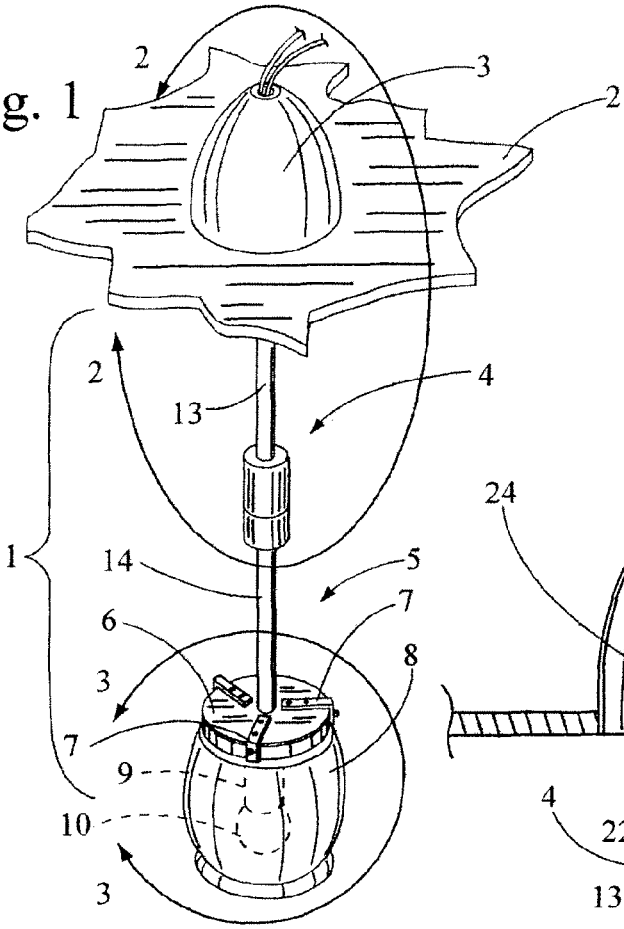
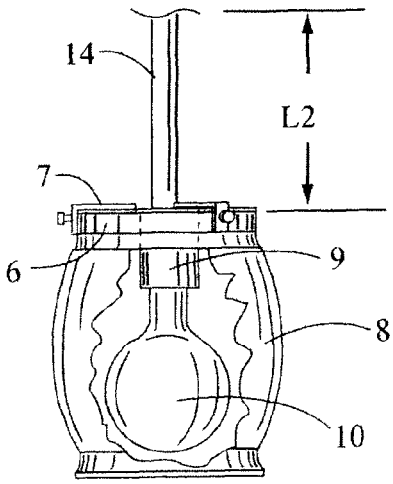
Fig. 3
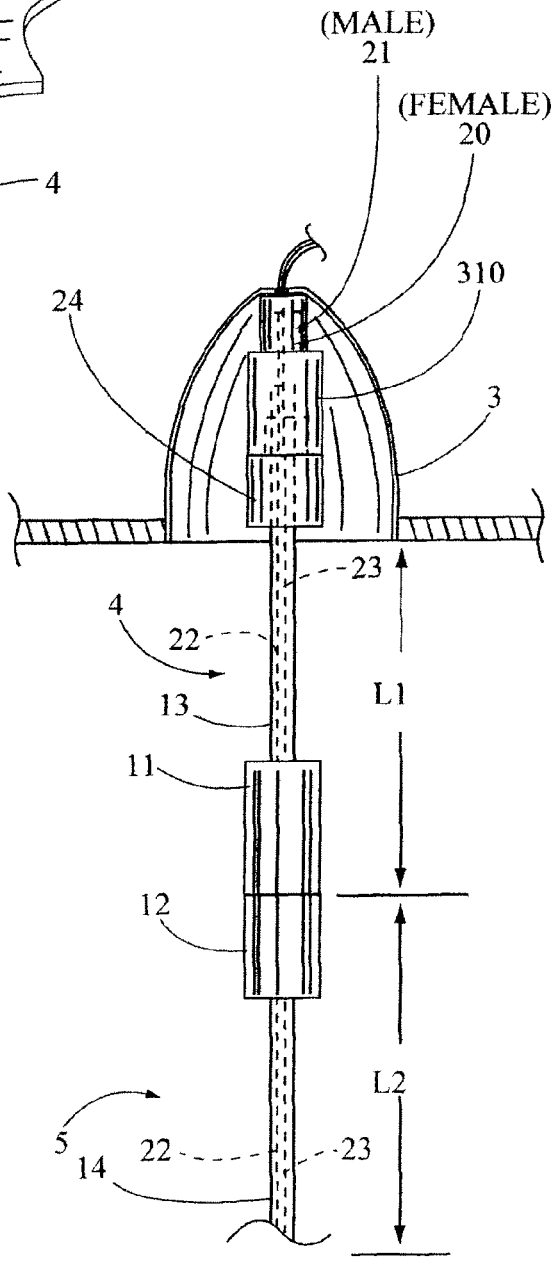
Fig. 2

17 / 19

RECESSED LIGHT EXTENSION SOCKET

CROSS REFERENCE APPLICATIONS

This application is a continuation-in-part of application Ser. No. 11/613,484 filed on Dec. 20, 2006, which was a divisional of application Ser. No. 11/056,178 filed on Feb. 10, 2005 and issued as U.S. Pat. No. 7,153,167 on Dec. 26, 2006.

FIELD OF INVENTION

The present invention relates to starting with a standard ceiling recessed lighting fixture and screwing in an extension rod to provide a socket lower (perhaps by several feet) than the ceiling, for example to better illuminate a restaurant table.

BACKGROUND OF THE INVENTION

It is known to screw an electric adapter into a standard ceiling recessed fixture. Hampton Bay™ provides an adapter male plug that screws into the ceiling light fixture. It powers a track fixture head which mounts to a canopy that covers the original ceiling light fixture. A standard track light fixture snaps into the track fixture head.

U.S. Pat. No. 6,113,433 (2000) Al-Turki discloses a one to two bulb AC ceiling light fixture adapter. The two-bulb extension receives one threaded bulb and one bayonet bulb.

A brief summary of related art follows below:

Hampton Bay™ sells a light fixture extension which allows a halogen light fixture to be powered by a standard ceiling light bulb fixture.

U.S. Pat. No. 394,680 (1888) to Dawes discloses a ceiling mounted rod that swivels and to which is attached a power cord and light bulb fixture.

U.S. Pat. No. 684,264 (1901) to Kemmerer discloses a ceiling mounted rod that swivels and supports a bulb fixture at its end.

U.S. Pat. No. 806,516 (1905) to Berry discloses a ceiling mounted two-piece swiveling rod fixture for a bulb fixture.

U.S. Pat. No. 866,473 (1907) to Keefe et al. discloses a ceiling fixture with a swiveling rod and a wire coil end for a bulb fixture.

U.S. Pat. No. 1,263,783 (1918) to Maier discloses a ceiling fixture with a swiveling rod.

U.S. Pat. No. 1,297,211 (1919) to Magress discloses a ceiling fixture with a swiveling rod.

U.S. Pat. No. 1,348,949 (1920) to Johansson discloses a ceiling fixture with a swiveling rod.

U.S. Pat. No. 1,934,624 (1933) to Guth discloses a flexible stem on a ceiling fixture.

U.S. Pat. No. 2,115,898 (1938) to Zagora discloses a swivel-type rod ceiling fixture.

U.S. Pat. No. 2,217,533 (1940) to Wolarsky discloses a telescoping rod light fixture.

U.S. Pat. No. 2,446,736 (1948) to Biller discloses a suspension support for fluorescent lights.

U.S. Pat. No. 2,753,445 (1956) to Thomas et al. discloses a ceiling fixture with a stem.

U.S. Pat. No. 2,767,953 (1956) to Wolar discloses a ceiling fixture and canopy support.

U.S. Pat. No. 5,257,172 (1993) to Erickson discloses a portable AC trouble light.

U.S. Pat. No. 5,317,493 (1994) to Muller et al. discloses an inclined ceiling light fixture.

U.S. Pat. No. 6,113,433 (2000) to Al-Turki discloses an adapter that screws into a bulb socket and has multiple sockets in it.

U.S. Pat. No. 6,409,365 (2002) to Lin discloses a hanging fixture.

U.S. Pat. No. 6,474,829 (2002) to Clodfelter discloses a receptacle mounted light fixture.

U.S. Pat. No. Des. 298,657 (1988) to Flores discloses a dual-ended extension cord.

U.S. Patent No. 2003/0235049 discloses a decoration multi-bulb fixture.

U.S. Patent No. 2003/0161149 discloses a collar for a ceiling fixture to enable an extended length bulb to have a diffuser.

What the prior art doesn't suggest is a rod-like extender to lower a socket from the ceiling, for example, to a few feet above a restaurant table or a pool table. The present invention provides such a simple, screw-in type extension rod for light bulb sockets. Although the preferred embodiment shows use with a ceiling mounted recessed type lighting fixture, any threaded lighting socket can be used with the present invention. Another embodiment supports a ceiling fan from a ceiling mounted recessed type lighting fixture.

SUMMARY OF THE INVENTION

An aspect of the present invention is to provide an easy-to-install rod into a screw type (Edison type bulb or other) socket, thereby extending an Edison socket (or if desired a Bayonet or other type socket) several feet away from the original socket.

Another aspect of the present invention is to provide a mating capability among a series of the extension rods.

Another aspect of the present invention is to provide a shroud over the extended light socket.

Another aspect of the present invention is to provide for either a rigid rod or a flexible extension.

Another aspect of the present invention is to provide a line voltage to low voltage converter in certain embodiments.

Another aspect of the present invention is to support a ceiling fan from a ceiling mounted recessed type lighting fixture.

Other aspects of this invention will appear from the following description and appended claims, reference being made to the accompanying drawings forming a part of this specification wherein like reference characters designate corresponding parts in the several views.

The AC to AC embodiment provides a male adapter to go into a female socket, nominally in a ceiling mounted recessed light fixture. A rigid rod extends from the adapter housing to two AC wires. The wires are electrically connected internally to a female socket at the opposite end of the extension rod. A light shroud is attached over the female socket. A flexible rod or wire embodiment has a strain relief cable inside the flexible rod or wire to hold the weight of the female socket, bulb, and shroud. Multiple rods, either solid or flexible, can be screwed together.

A line voltage to low voltage system adds a transformer at the ceiling end of the extension rod. Twelve-volt bulbs can be used. One embodiment features a clamp that fits in a recessed ceiling light fixture to support a ceiling fan.

BRIEF DESCRIPTION OF THE DRAWINGS

FIG. 1 is a top perspective view of a ceiling recessed light fixture with an AC/transformer extension adapter installed.

FIG. 2 is a side partial cutaway view of the FIG. 1 embodiment.

FIG. 3 is a partial cutaway view of the lowered bulb of FIG. 1.

Figure 4:
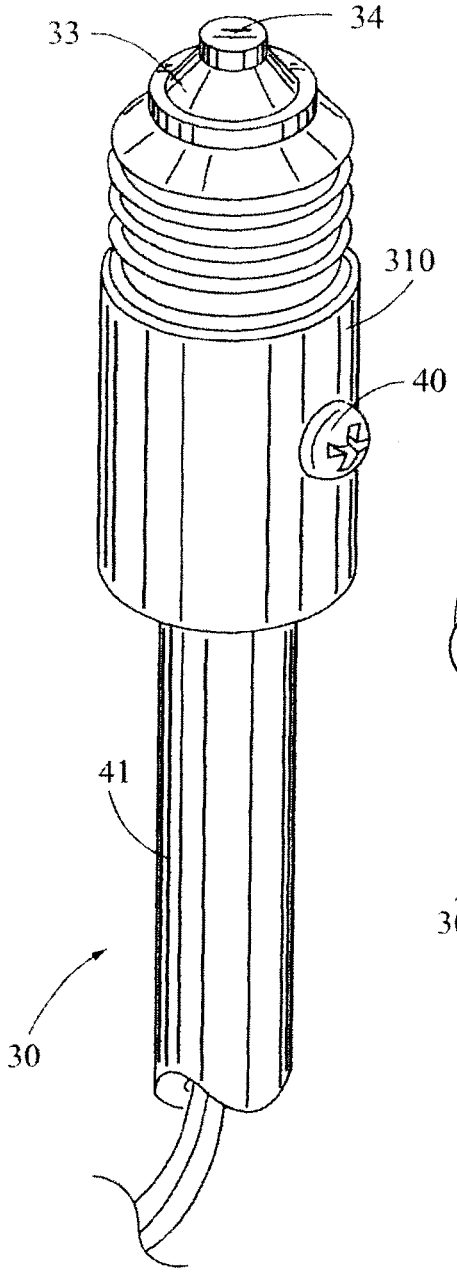
FIG. 4 is a top perspective view of a male adapter.
Figure 5:
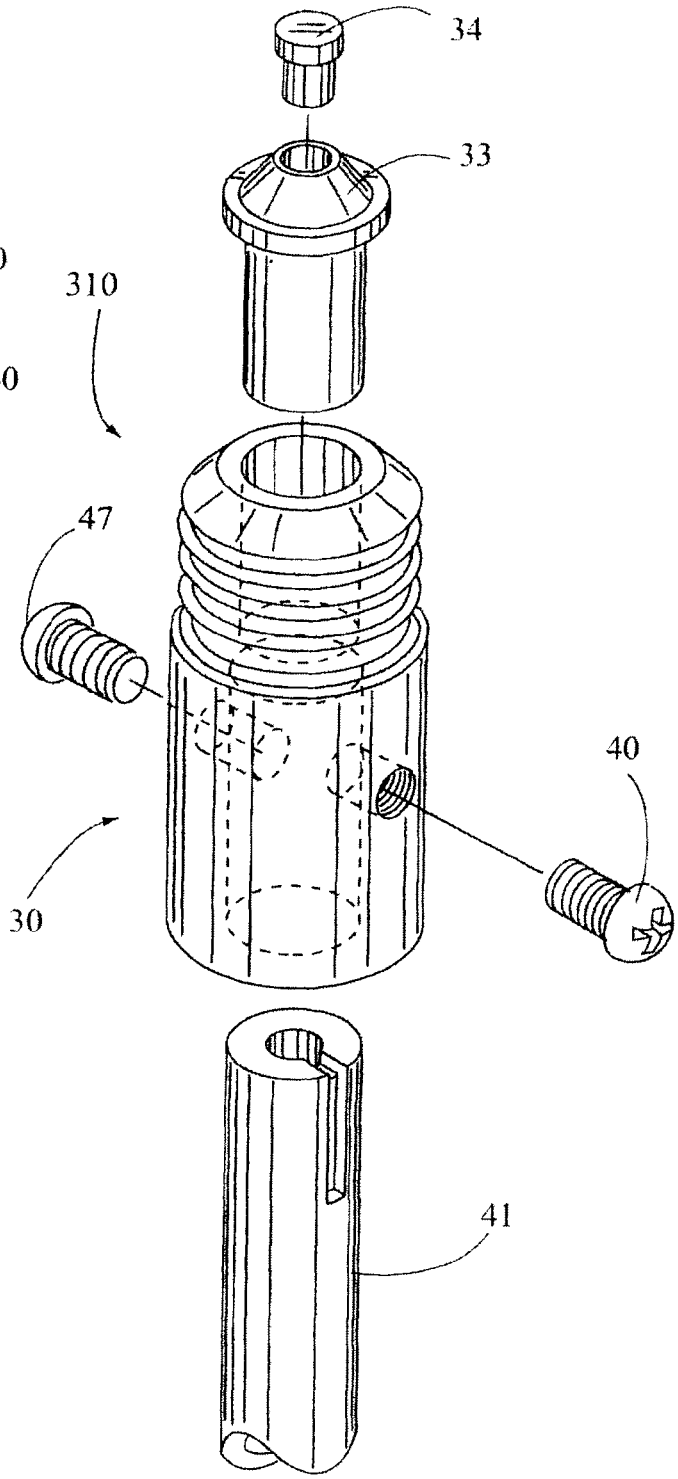
FIG. 5 is an exploded view of FIG. 4, without the two wires.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Referring first to FIGS. 1, 2 a line voltage to low voltage extension adapter 1 consists of an upper extension rod 4 into which a lower extension rod 5 is screwed. The ceiling 2 has a prior art recessed lighting fixture 3 which has a female socket 20. The extension rod 4 consists of an upper male adapter 21, a hollow rod 13, and a female socket 11. A line voltage to low voltage transformer 24 converts the line voltage to the low voltage needed for 12 volt lighting. Male adapter 310 presents two AC line voltage wires to the transformer 24. Wires 22, 23 run down the hollow of rod 13 to female socket 11, carrying the low voltage.

The extension rod 5 consists of male adapter 12 which screws into female socket 11. Hollow rod 14 contains wires 22, 23 which power female socket 9 and bulb 10. A plate 6 (same as FIG. 9) connects to rod 14. Brackets 7 support a shroud 8. Design choice can select lengths L1, L2. Designers can place bulb 10 over a pool table or a restaurant table as they choose without the cost of re-wiring and replacing the recessed lighting fixture 3.

Referring next to FIGS. 4-7 an AC system is shown, wherein the designer can lower the height of a standard AC bulb from a standard ceiling fixture.

FIGS. 4,5,6,7 represent AC extension rod 30. Extension rod 30 consists of a male adapter 310, a hollow, non-conductive rod 41, and a female socket 311. Nominally rod 41 can be made of plastic. The male adapter 310 is a conductor having a hollow 50 to receive the rod 41. A screw 47 threads through threaded hole 45 into recess 51, thereby securing the rod 41 via its recess 51. Threads 32 are standard AC bulb socket threads 1 1/16 OD, 7 threads per inch. A conductive button 34 is housed in the center insulator 33. The uninsulated tip 35 of the hot insulated wire 42 is soldered to the conductive button 34 in a known manner. The insulated neutral wire 37 has an uninsulated end 38 which fastens to the conductive male end 31 via screw 40 threaded through hole 39. The pair of insulated wires 37, 42 are housed in the hollow 500 of rod 41 and hollow 36 of male end 36.

The female end 600 is insulated from conductive button 340 at its base 602 via center insulator 607 in a known manner. Threads 601 in hollow 605 receive a standard AC bulb or a male end 31 with threads 32.

Figure 9:
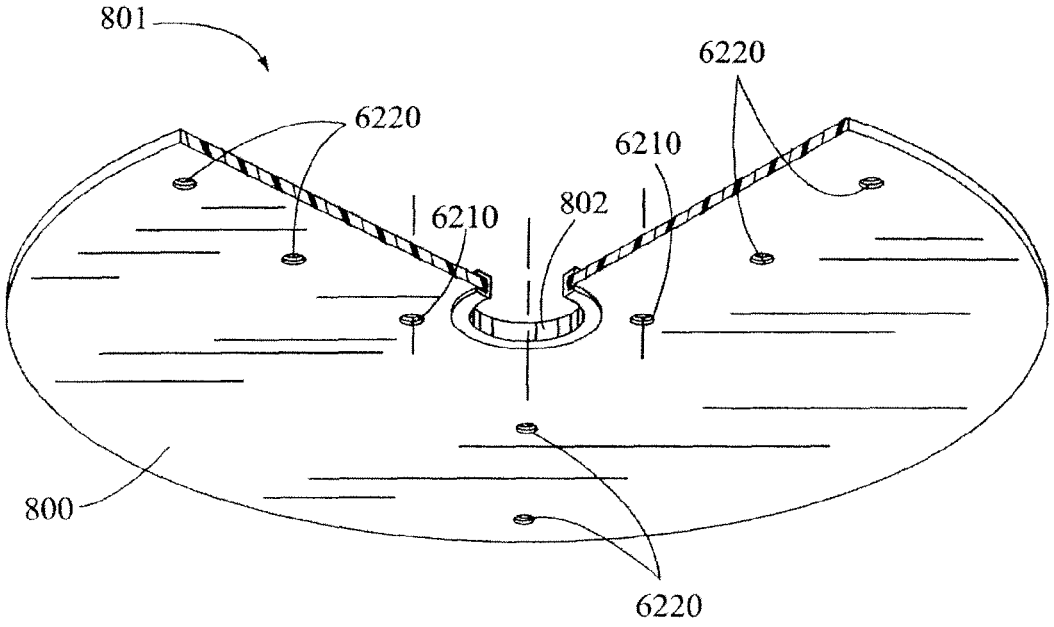
FIG. 9 is a partial cutaway view of a lampshade holder plate.

Holes 620 receive screws 621 thereby fastening a plate or a shroud as seen in FIG. 9.

Figure 7:
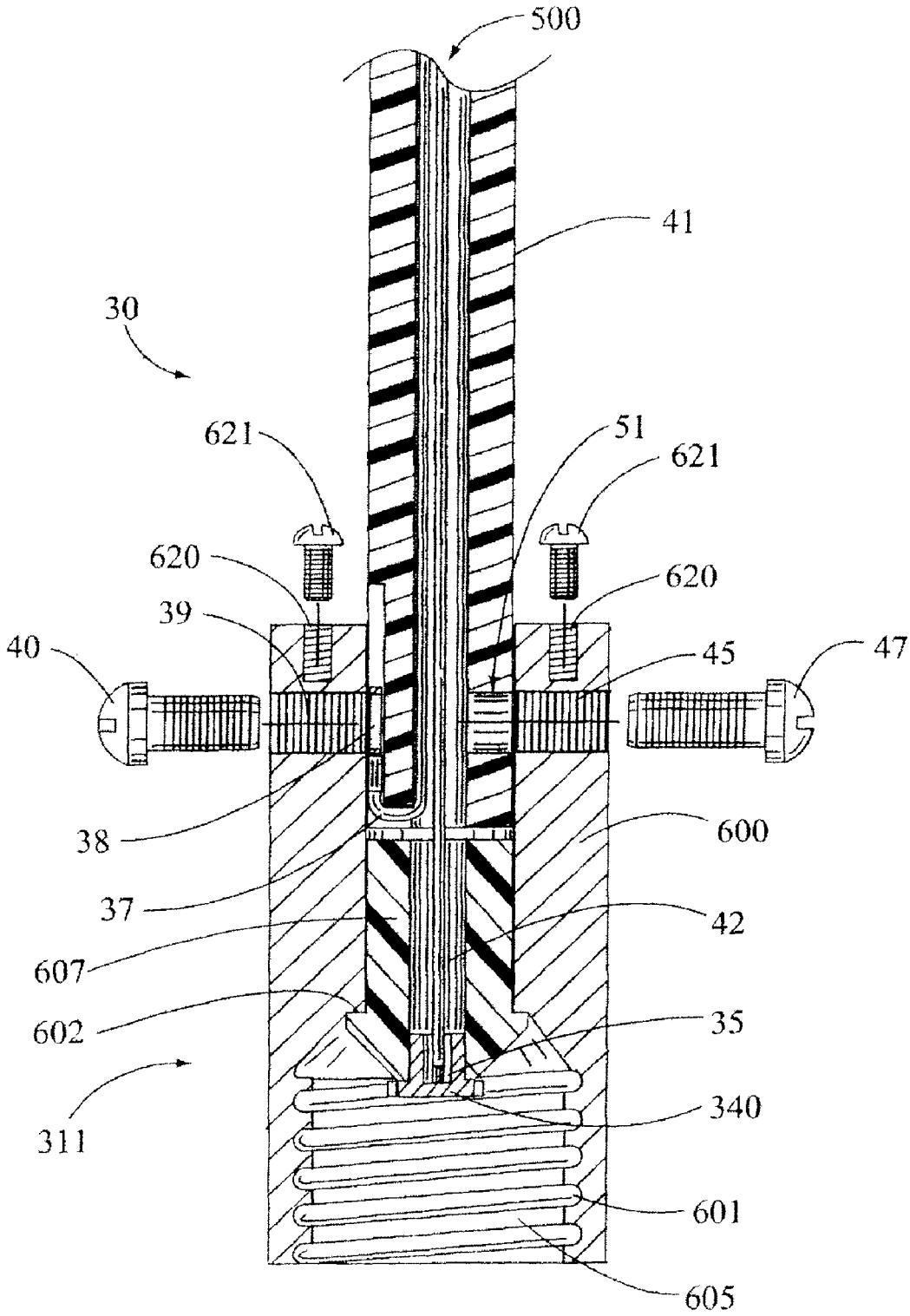
FIG. 7 is a cross sectional view of the female end.

FIG. 9 shows holes 6210 which receive screws 621 of FIG. 7. This plate 800 then accepts the brackets 7 of FIG. 1, via mounting holes 6220 which in turn support shroud 8 of FIG. 1. A rod 41 fits in hollow 802 forming a shroud assembly 801.

Figure 8:
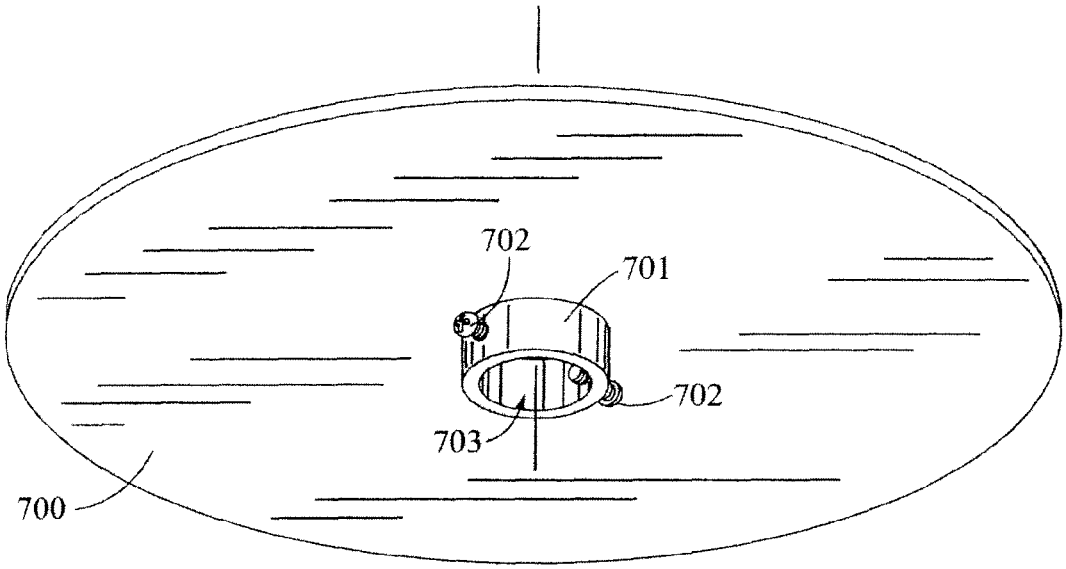
FIG. 8 is a perspective view of a ceiling closeout plate.

The plate 700 in FIG. 8 would normally be mounted with the collar side facing the female end 600 of FIG. 7. The collar 701 would be placed around the rod 41 while it was detached from either the male end 31 or the female end 600. Locking screws 702 can secure the plate 700 anywhere along rod 41 via hollow 703, to close out the recessed lighting fixture recess in the ceiling.

Figure 10:
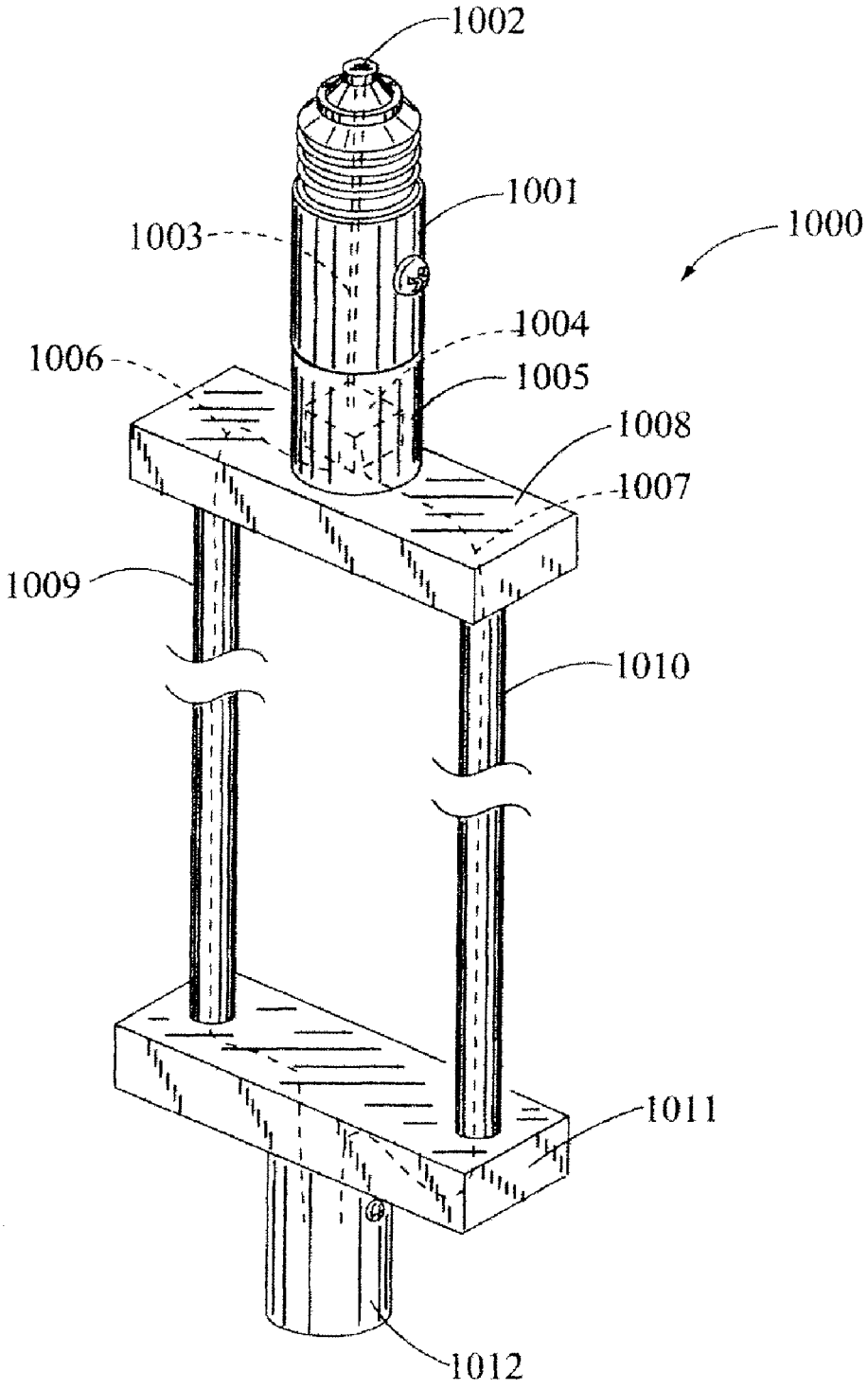
FIG. 10 is a top perspective view of a line voltage to low voltage alternate embodiment.

Referring next to FIG. 10 a line voltage to low voltage extension rod 1000 consists of a male adapter 1001 with a standard contact button 1002. Wires 1003 carry AC voltage to a transformer 1004 housed in a cylindrical housing 1005. Low voltage wires 1006, 1007 travel through cross bracket 1008 and then down hollow rods 1009, 1010, and then through cross bracket 1011 and into female socket 1012, which would normally hold a 12 volt bulb.

Figure 6:
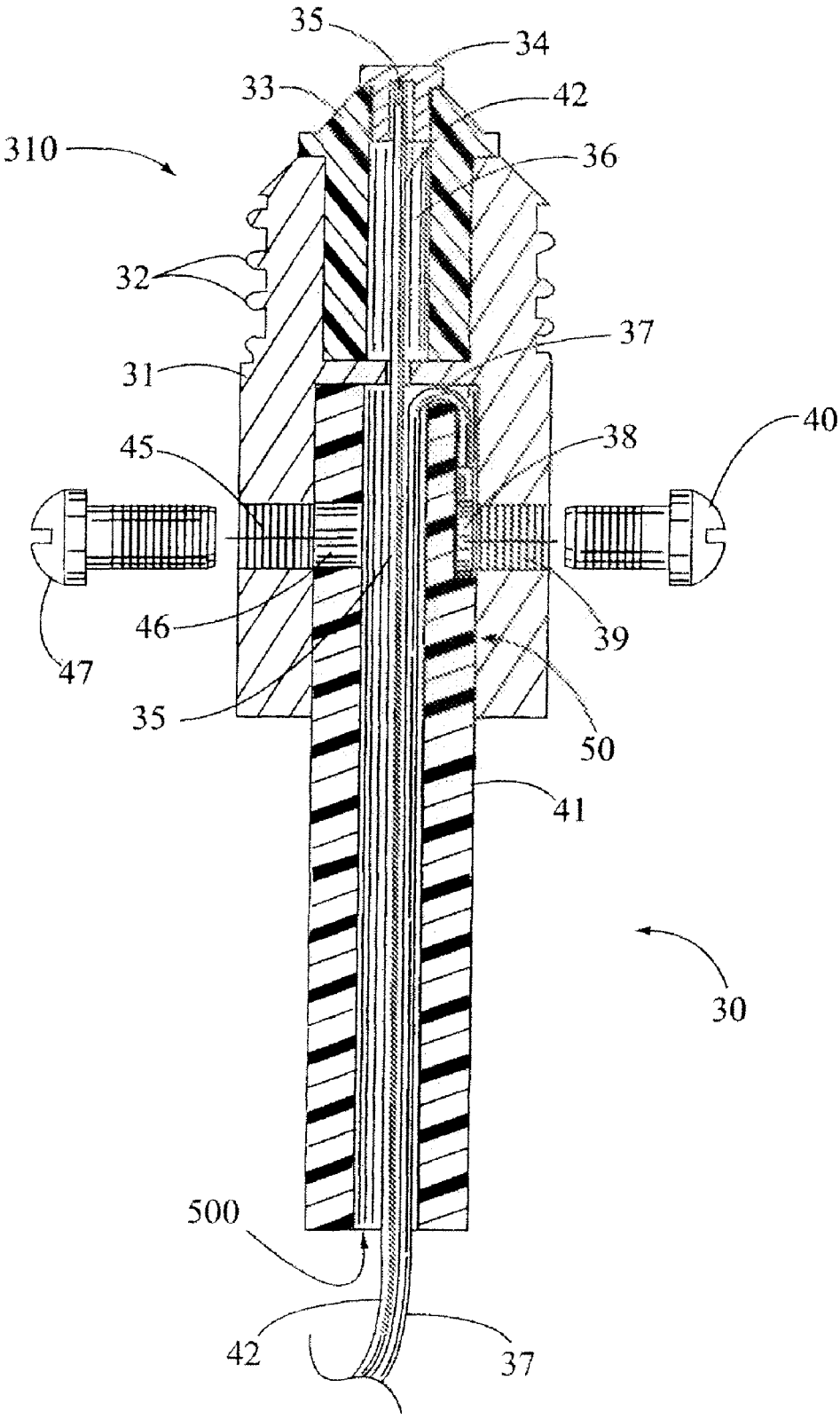
FIG. 6 is a cross sectional view of the male end.
Figure 11:
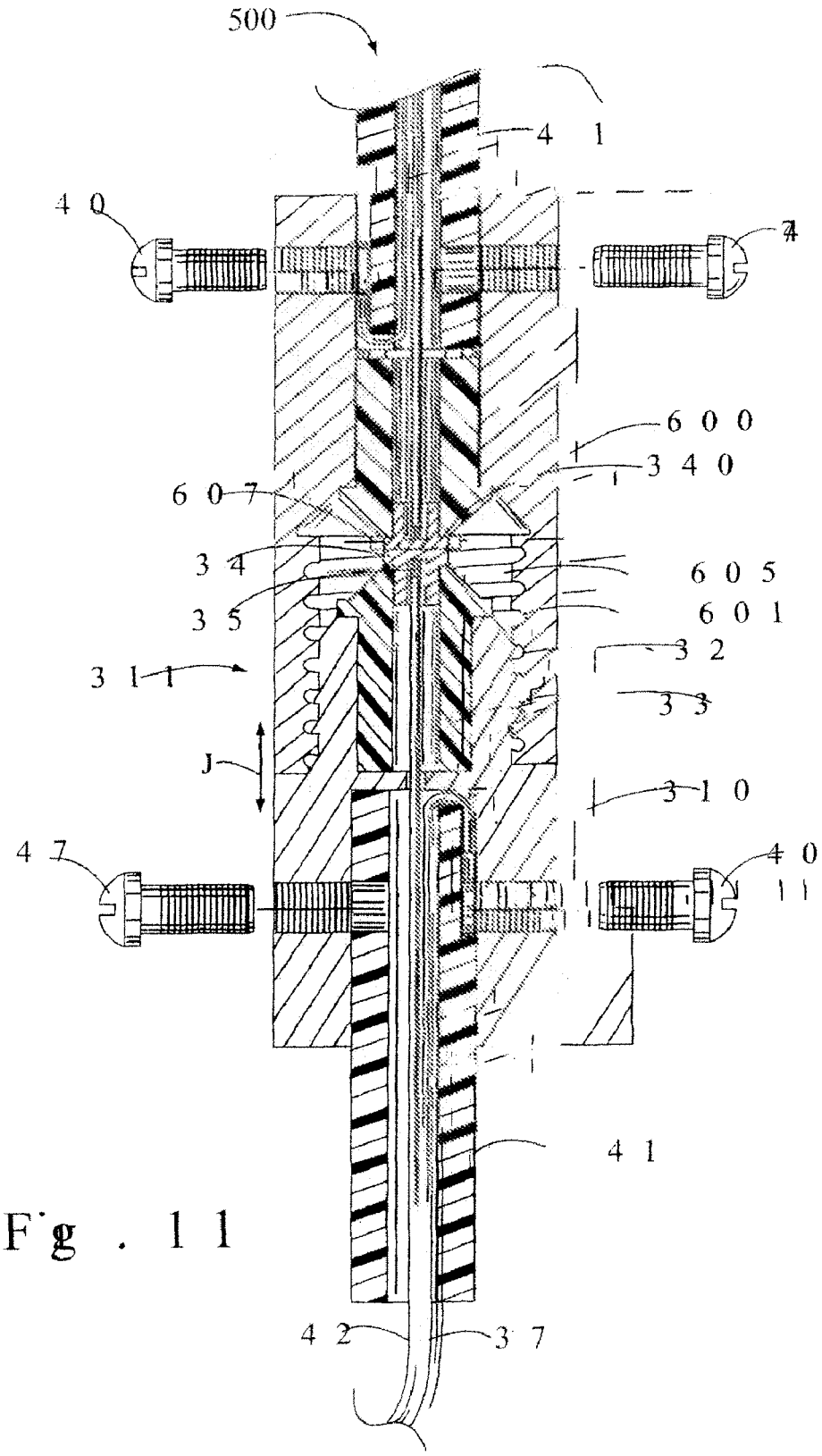
FIG. 11 is a cross sectional view of a mated male end female pair.

Referring next to FIG. 11, the male adapter 310 of FIG. 6 is shown screwed into the female socket 311 of FIG. 7. There is formed a smooth joint J along the exterior mated surfaces of 310 and 311.

Figure 12:
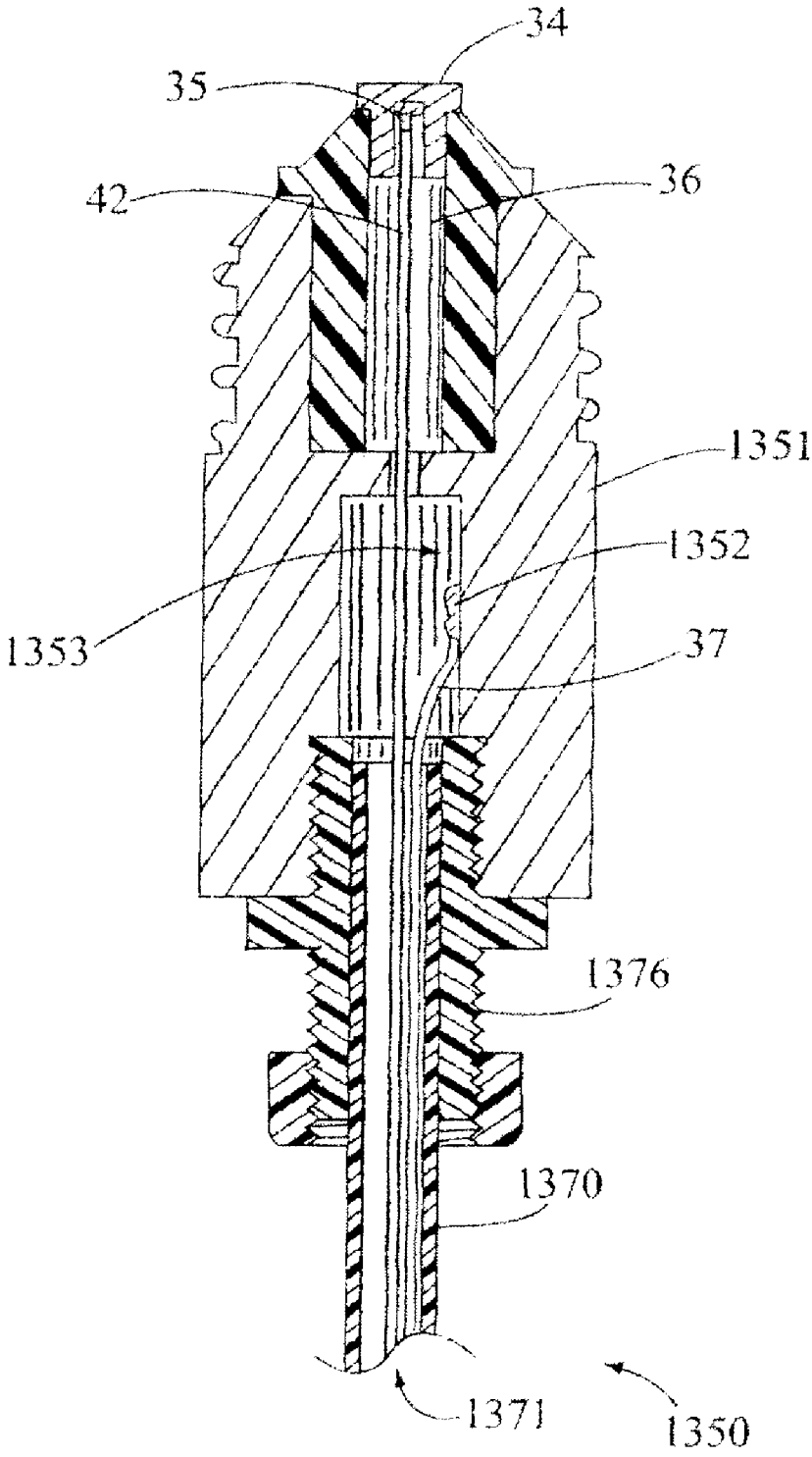
FIG. 12 is a cross sectional view of an alternate flexible embodiment male end.
Figure 13:
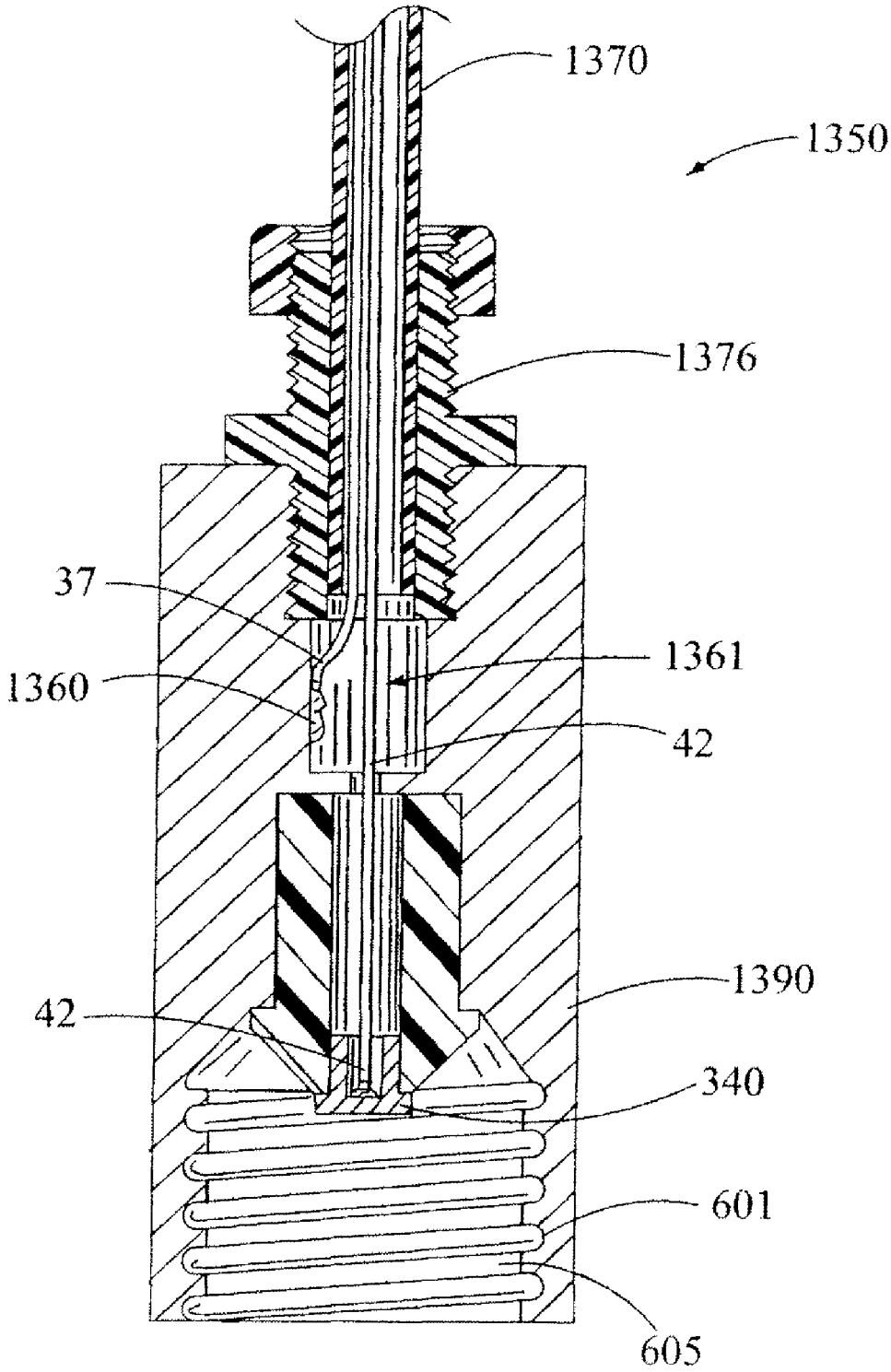
FIG. 13 is a cross sectional view of the female end of the FIG. 12 embodiment.

Referring next to FIGS. 12, 13 a two conductor flexible conductor 1350 is shown. The male adapter 1351 has the same contact button 34 as in FIG. 6. However, the neutral wire 37 has a solder connection 1352 to an inside wall of a hollow 1353 of the male adapter 1351.

The cable 1370 has a hollow 1371, and the cable 1370 is flexible, wherein strain relief 1376 can provide structural integrity for the weight of the female socket 1390. Strain relief connectors 1376 secure the cable 1370 to the male/female ends. The solder connection 1360 is in hollow 1361 of female socket 1390.

Figure 14:
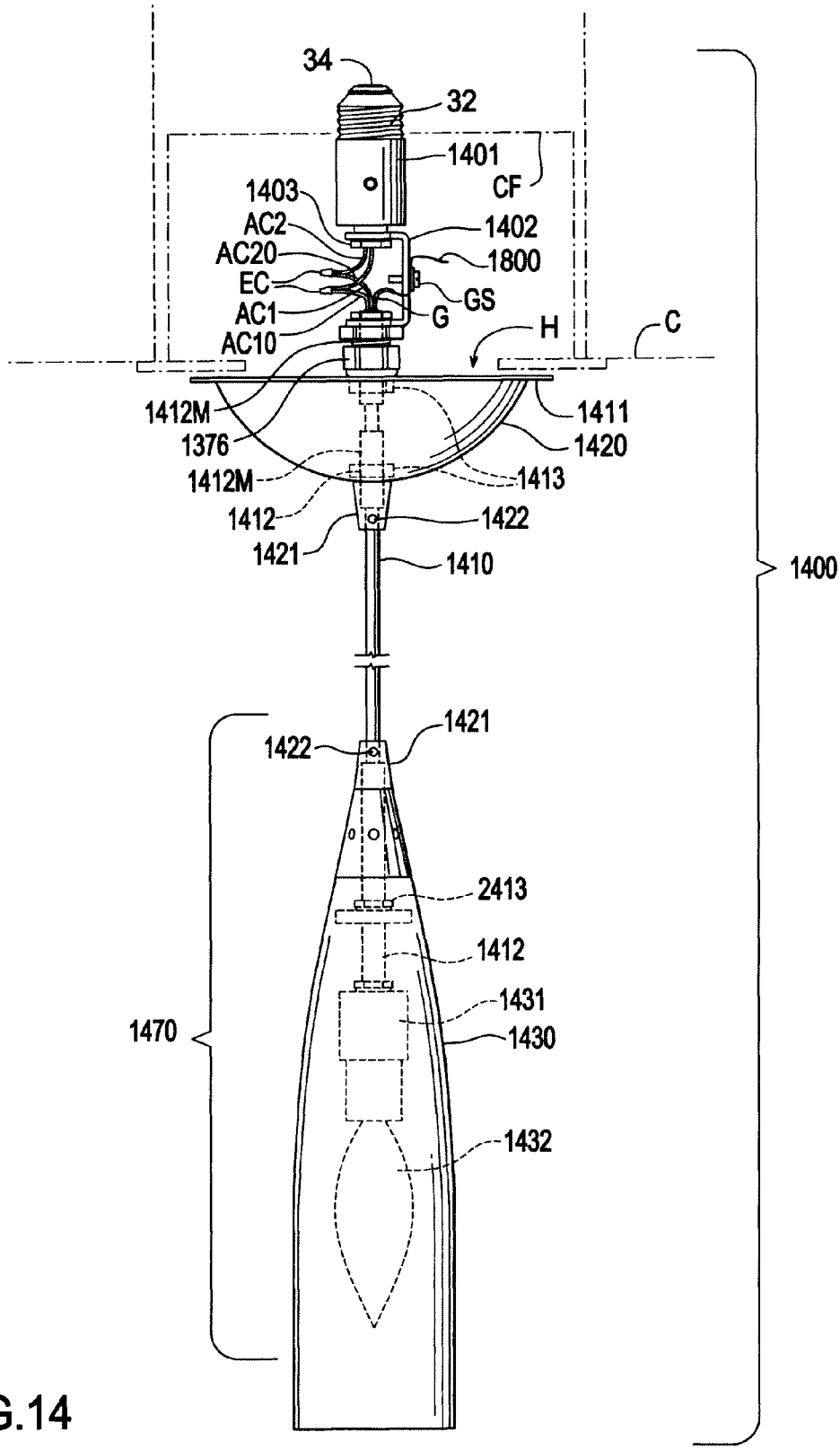
FIG. 14 is a side plan view of an alternate embodiment flexible cable extension lamp.
Figure 15:
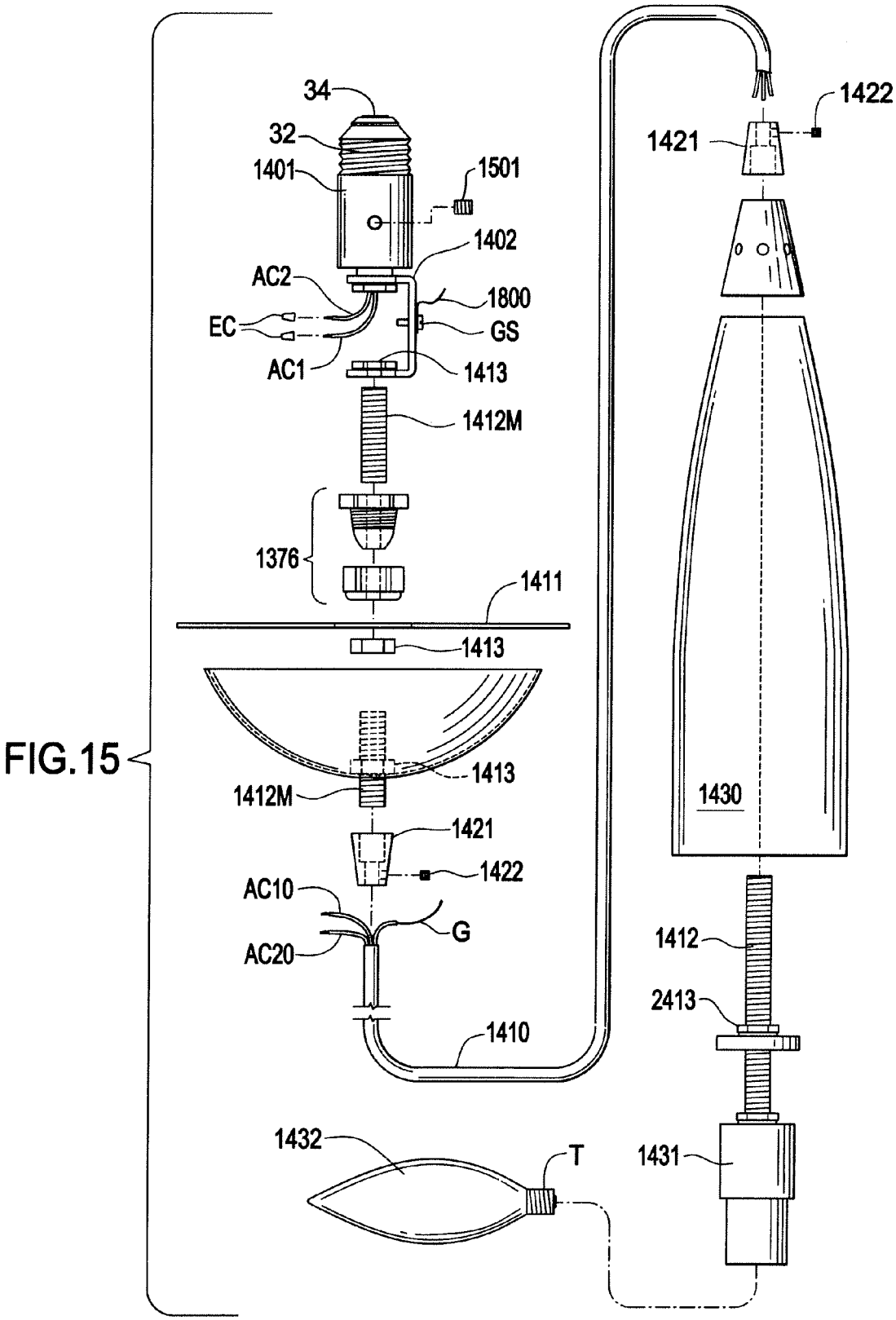
FIG. 15 is an exploded view of the FIG. 14 embodiment.
Figure 16:
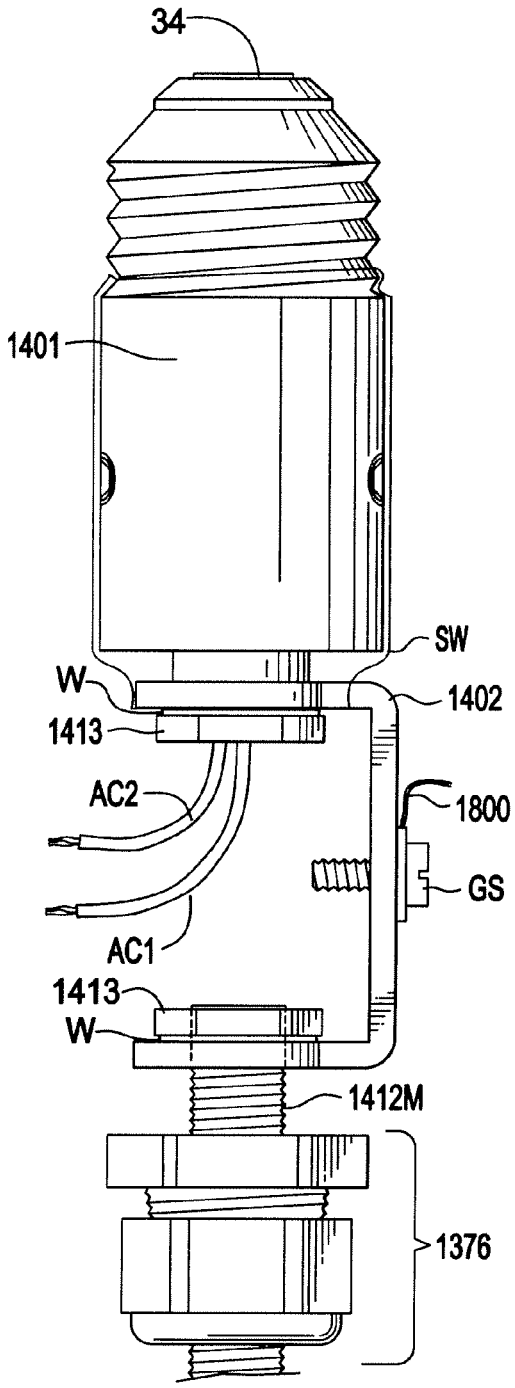
FIG. 16 is a side plan view of the male end of the FIG. 14 embodiment.
Figure 17:
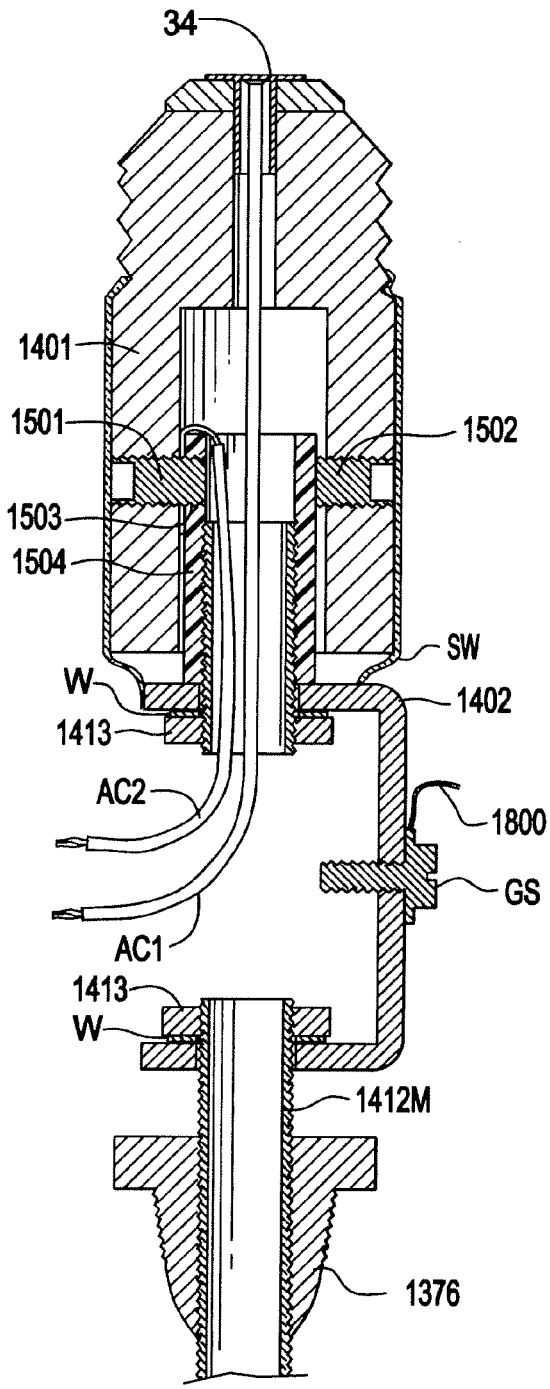
FIG. 17 is a longitudinal sectional view of the FIG. 16 male end.
Figure 18:
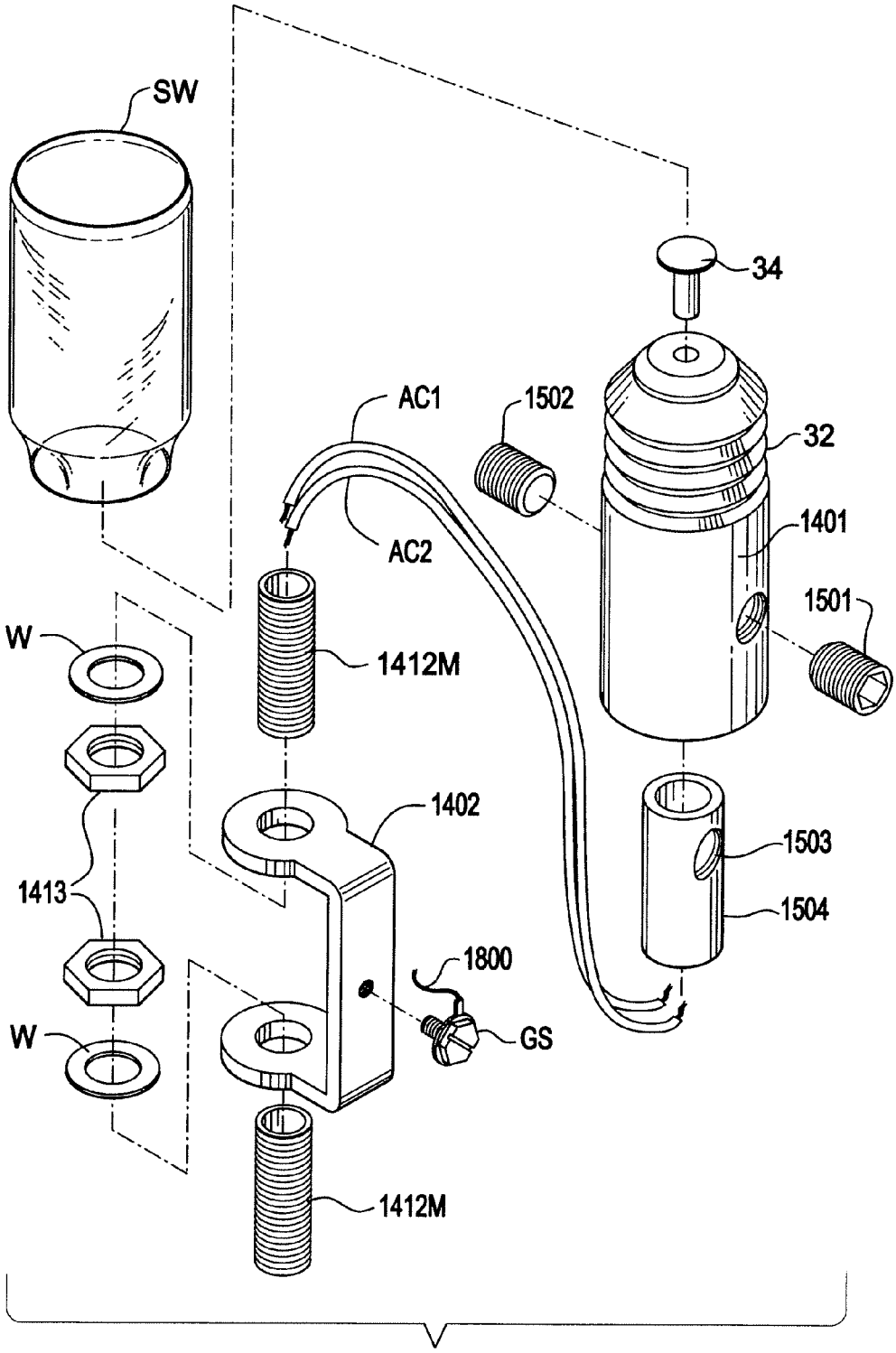
FIG. 18 is an exploded view of the FIG. 16 male end.

Referring next to FIG. 14 a flexible extension lamp 1400 has a male adapter 1401 with standard AC bulb socket threads 32 and a conductive button 34. The male adapter 1401 screws into the (not shown) standard female receptacle of the prior art recessed ceiling fixture CF which is mounted into the ceiling C.

A bracket known as a hickey 1402 is fastened to the bottom of the male adapter 1401 with a nut 1403. Male adapter wires AC1, AC2 are connected to flexible cable 1410 wires AC10, AC20 using end contacts EC. Cable ground wire G is connected to ground screw GS on hickey 1402 and then to a ceiling fixture CF ground, not shown.

A strain relief 1376 is a prior art device which secures the top end of flexible cable 1410 above the ceiling cover 1411. A mini all thread 1412M is secured above the ceiling cover 1411 with a nut 1413. Mini all thread 1412 secures the strain relief 1376. The canopy 1420 cover 1411 up against the hole H in the recessed ceiling fixture CF. A lower mini all thread 1412M and the nut 1413 in the canopy 1420 are held up by the collar 1421. Collar 1421 has a set screw 1422 to lock against flexible cable 1410.

The strain relief 1376 supports the flexible cable 1410.

Flexible cable 1410 supports a lamp assembly 1470. Lamp assembly 1470 is prior art and consists of a lampshade 1430, a socket 1431 and a bulb 1432. A traveling shelf 2413 is threaded along all thread 1412 to support the lampshade 1430 at a desired height.

Referring next to FIGS. 15, 16, 17, 18 everything below ceiling cover 1411 is prior art. The set screw 1501 threads through male adapter 1401 hole 1503 of plastic coupler 1504. Set screw 1502 threads through male adapter 1401 and into plastic coupler 1504. Threads to accept the mini all thread 1412M are threaded up to hole 1503. Washers W and nuts 1413 are prior art. Shrink wrap SW provides insulation. Ground lead 1800 is connected to a ceiling fixture CF ground. AC1 connects to conductive button 34. AC2 connects to the external metal body of male adapter 1401 by being pressed against 1401 with the force of set screw 1502 against coupler 1504. The bulb 1432 and socket 1431 can be of any chosen size and thread T width.

Figure 19:
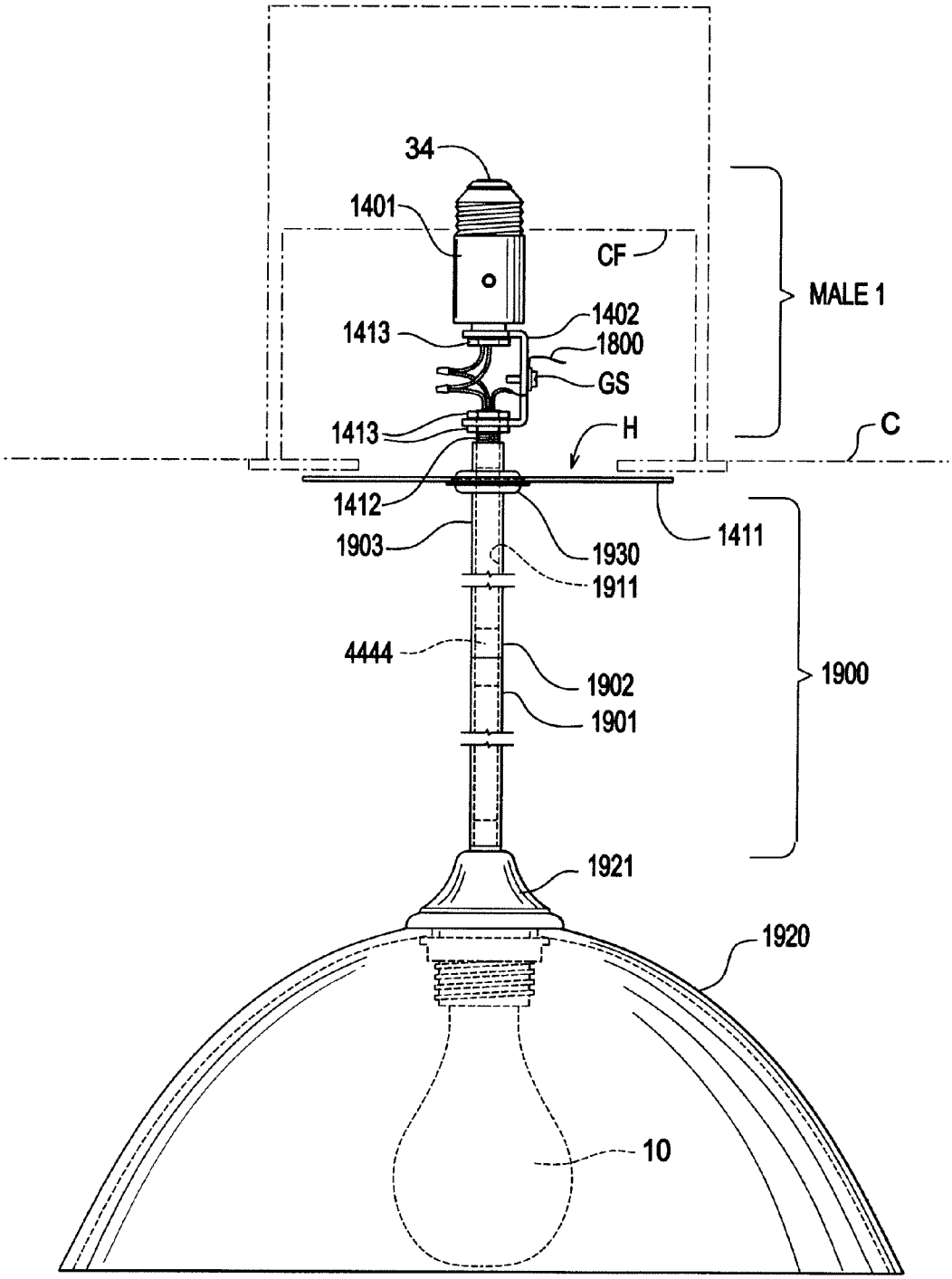
FIG. 19 is a side plan view of a rigid rod extension lamp using the FIG. 16 male end.
Figure 20:
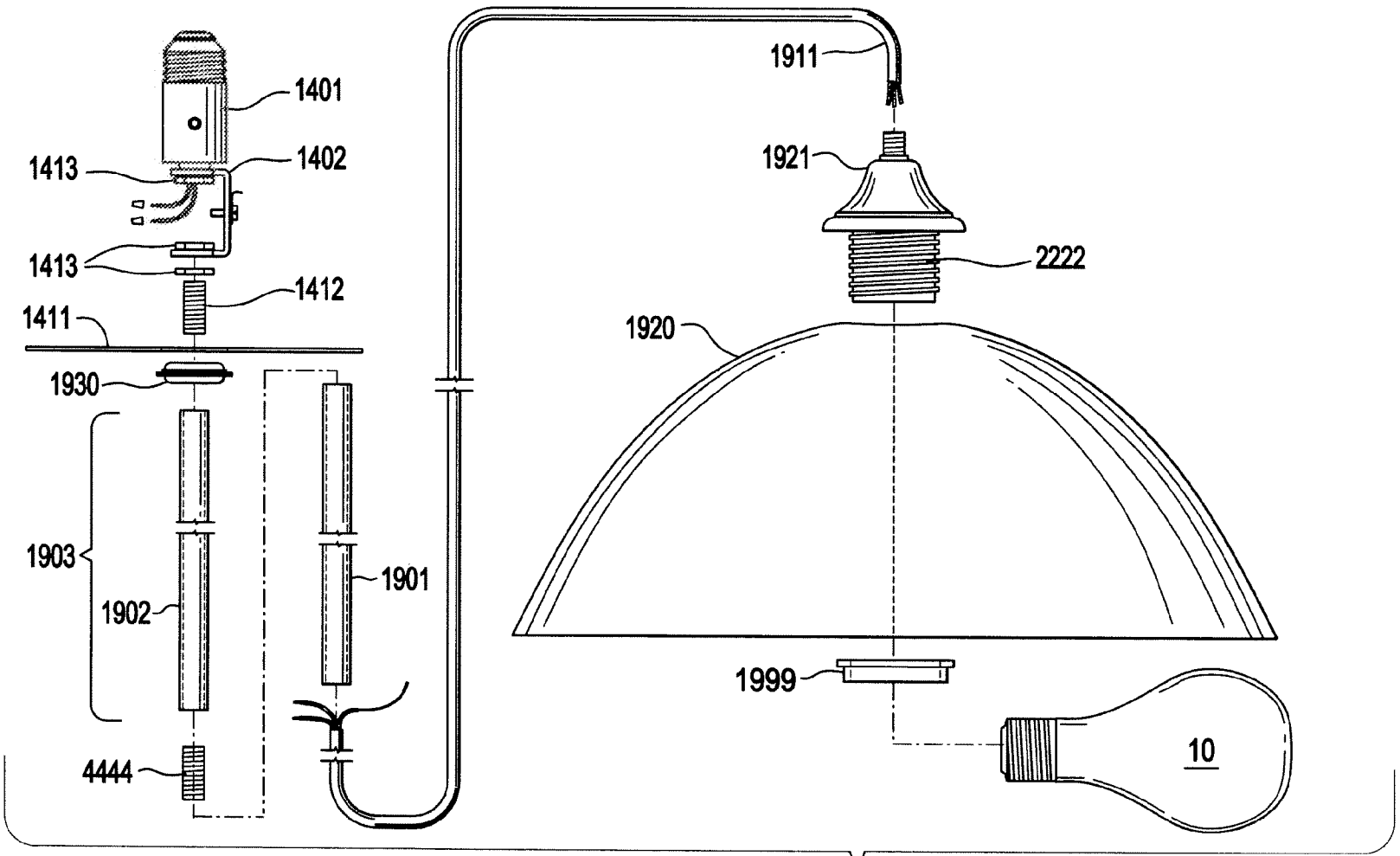
FIG. 20 is an exploded view of the FIG. 19 embodiment.
Figure 21:
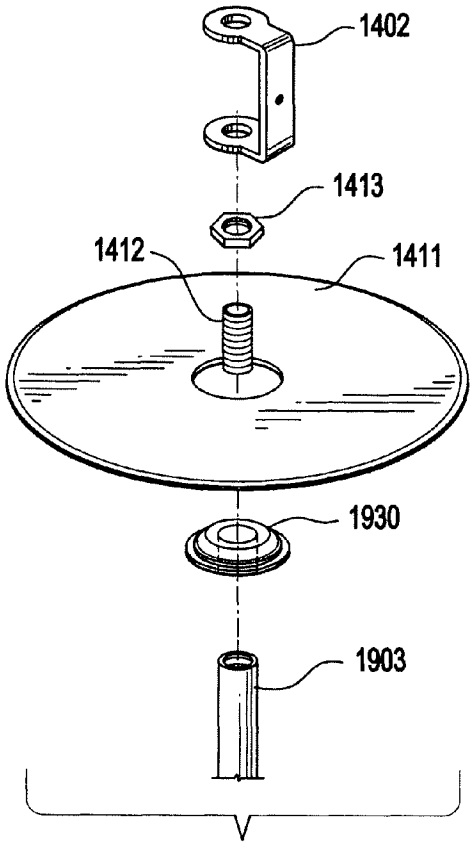
FIG. 21 is an exploded view of the ceiling fixture closure assembly shown in FIG. 19.

Referring next to FIGS. 19, 20, 21 a stopper 1930 has a rubber collar that slides on solid rod 1903 which is preferably made of metal. Rod 1903 may have segments 1901, 1902 which are joined by all thread segments 4444 to a chosen length forming rod assembly 1900. Stopper 1930 secures ceiling cover 1411 against hole H of ceiling fixture CF. Two nuts 1413 secure all thread 1412 to the lower arm of hickey 1402, wherein no strain relief is used in a rigid rod configuration. The electric cable 1911 is housed within rigid rod 1903. Except for the retaining ring 1999 everything below the ceiling cover 1411 is prior art, wherein the bulb 10 size and thread diameter is selected from any standard. Retaining ring 1999 screws into the outer threads 2222 of the female socket to hold dome 1920. Dome 1920 and dome cover 1921 are selected by the designer. The wiring is the same as shown in FIG. 14.

Figure 23:
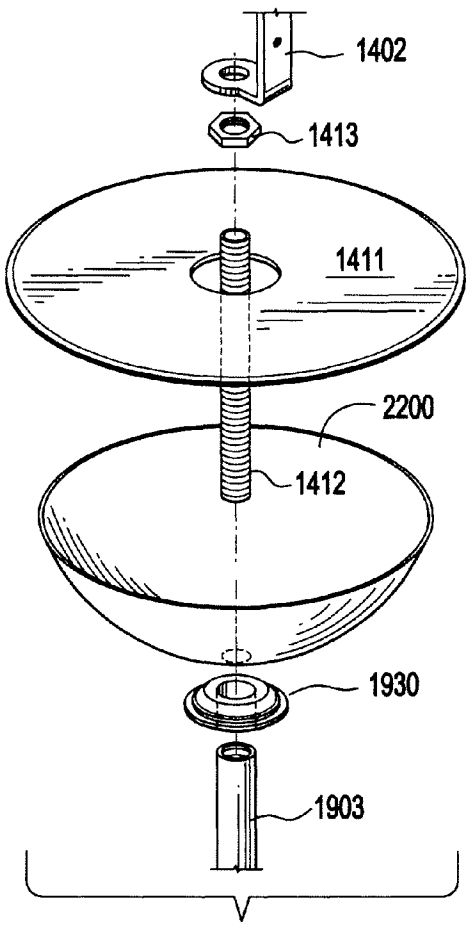
FIG. 23 is an exploded view of the FIG. 22 embodiment.
Figure 22:
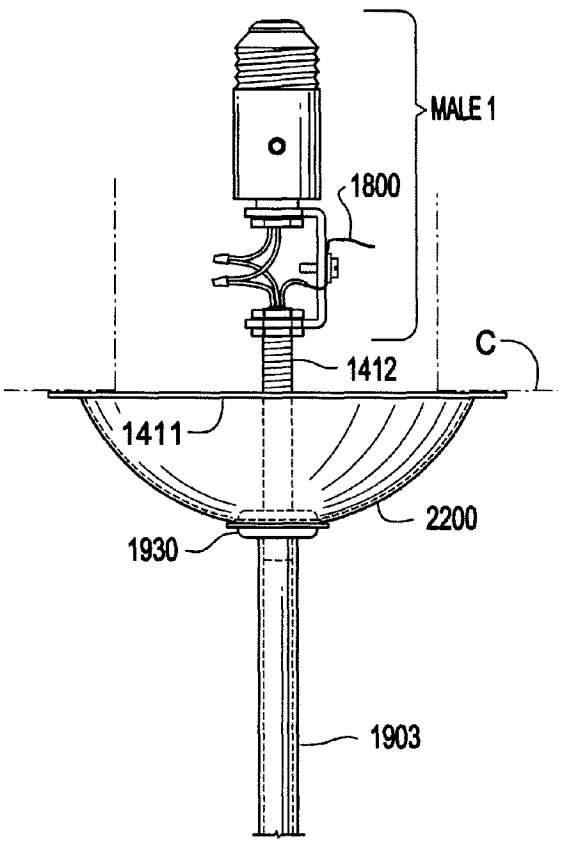
FIG. 22 is a side plan view of an alternate embodiment ceiling fixture closure assembly.

Referring next to FIGS. 22, 23 the male assembly MALE 1 will fit into any standard female receptacle in a recessed ceiling lighting fixture. A decorative canopy 2200 is secured against the ceiling cover 1411 by a stopper 1930 which is supported by rod 1903. The rigid rod 1903 is screwed into all thread 1412.

Figure 25:
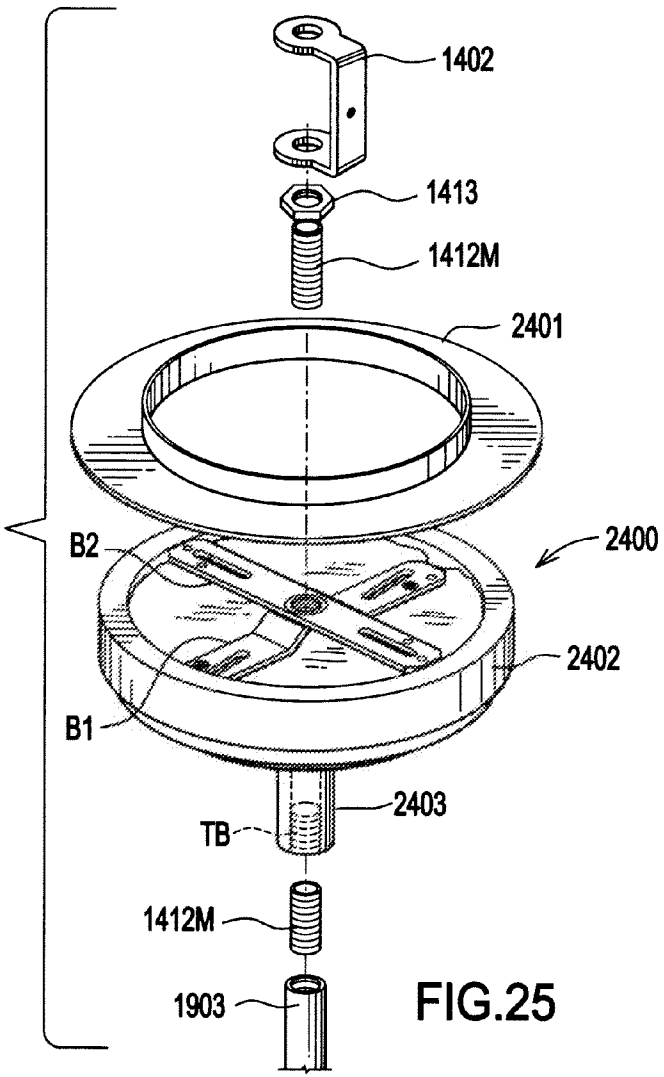
FIG. 25 is an exploded view of the ceiling fixture closure assembly for the FIG. 24 embodiment.
Figure 24:
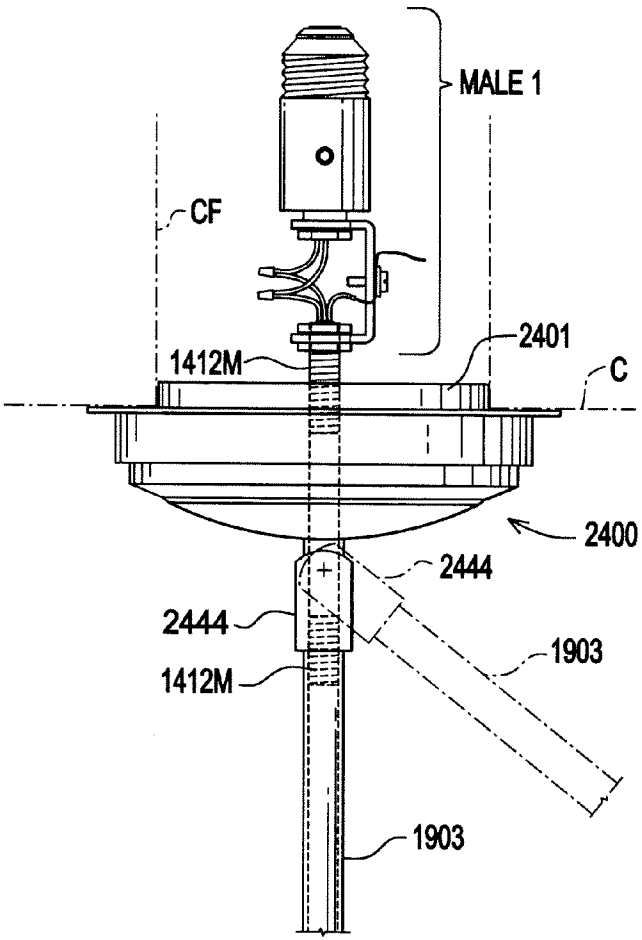
FIG. 24 is a side plan view of an alternate embodiment rigid rod lamp.

Referring next to FIGS. 24, 25 dome assembly 2400 is prior art. A ceiling cover 2401 matches canopy 2402. All thread 1412*m* supports the dome assembly 2400 from the hickey 1402. Dome base 2444 may pivot as shown by the dotted lines of rigid rod 1903 in FIG. 24. Canopy 2402 may have crossbars B1, B2 (prior art) and threads TB in its extension 2403.

Figure 27:
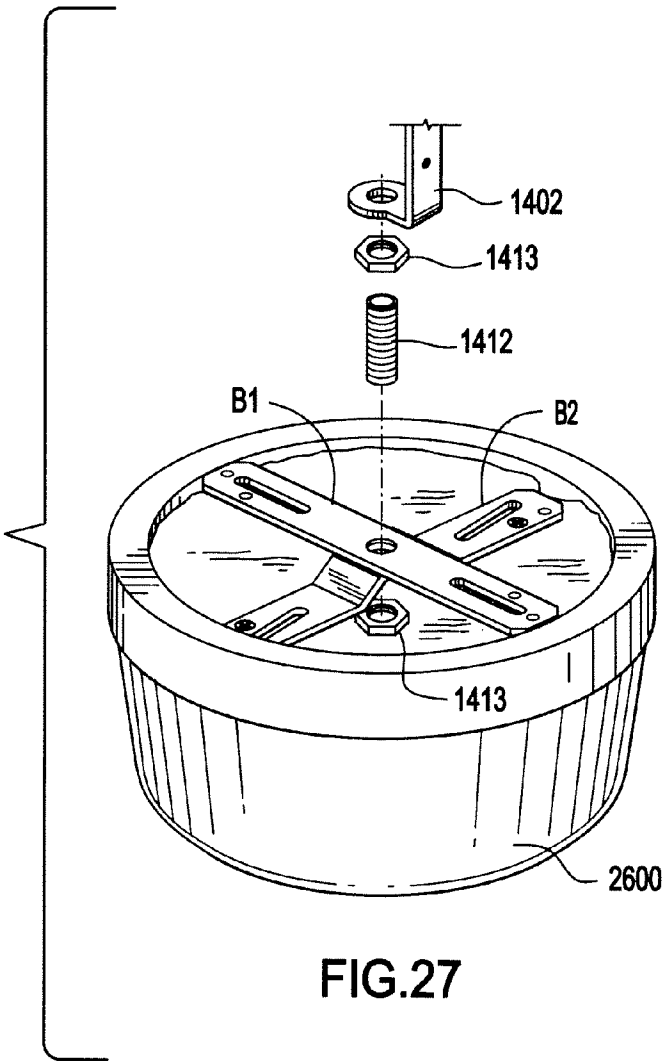
FIG. 27 is a top perspective view of the FIG. 26 embodiment.
Figure 26:
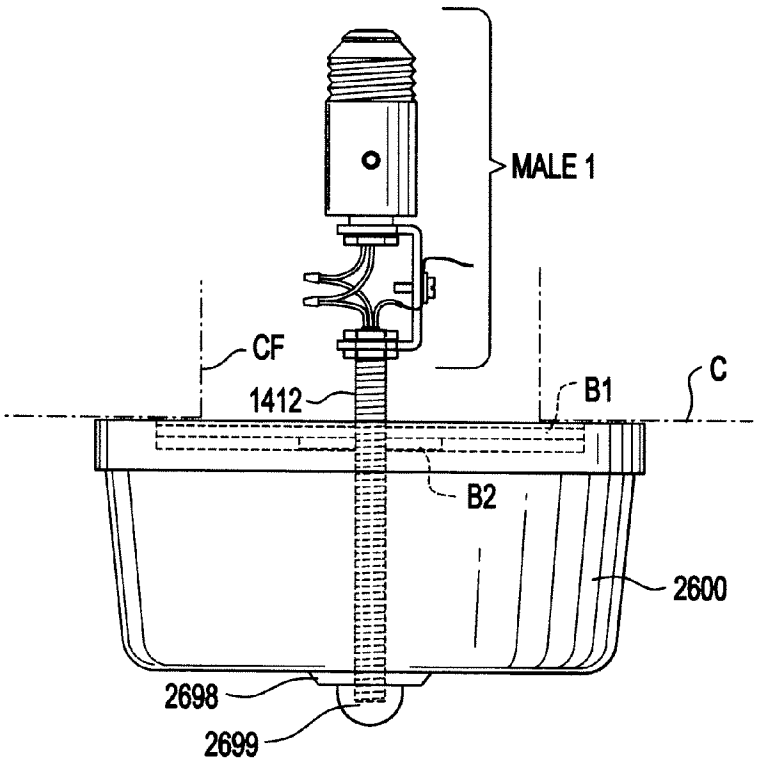
FIG. 26 is a side plan view of an alternate embodiment ceiling lamp.

Referring next to FIGS. 26, 27 a prior art dome light 2600 is wired into assembly MALE 1. Prior art brackets B1, B2 are used to support the dome light 2600 from the all thread 1412 via bottom nut 2699 threaded to tip 2698 of all thread 1412.

Figure 29:
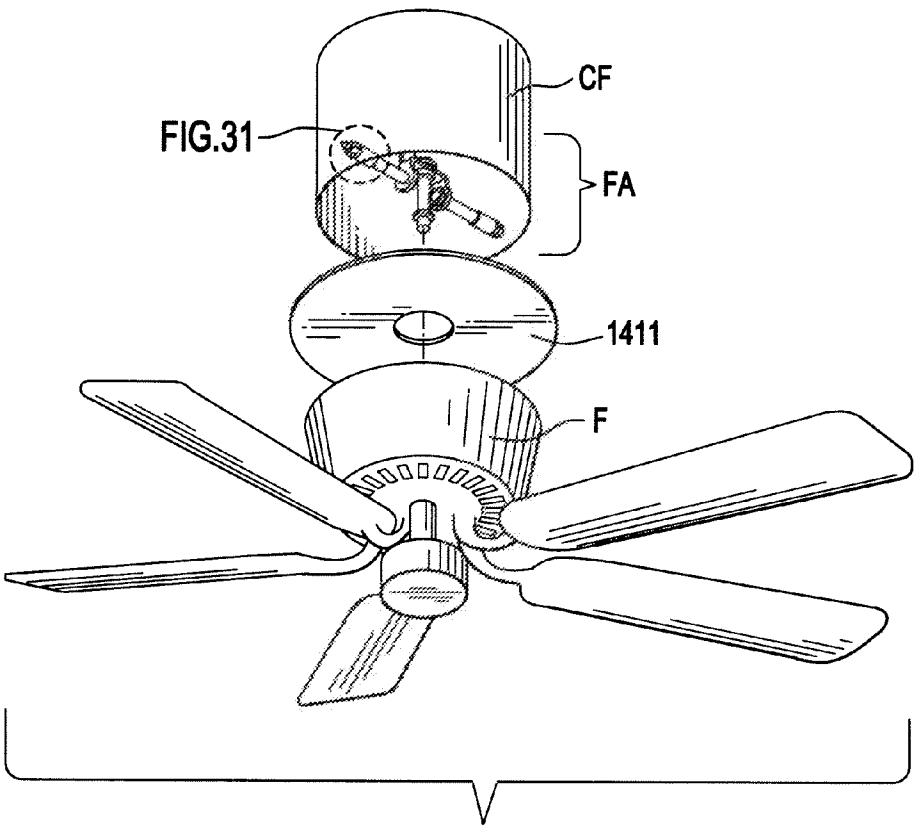
FIG. 29 is a exploded view of the FIG. 28 embodiment.
Figure 30:
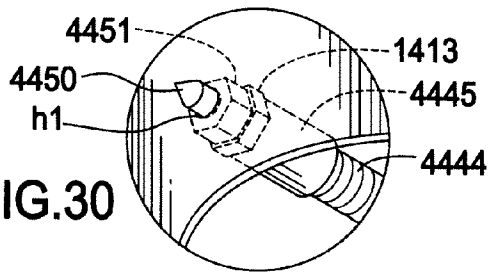
FIG. 30 is a close up view of the support tip of the FIG. 28 embodiment.
Figure 28:
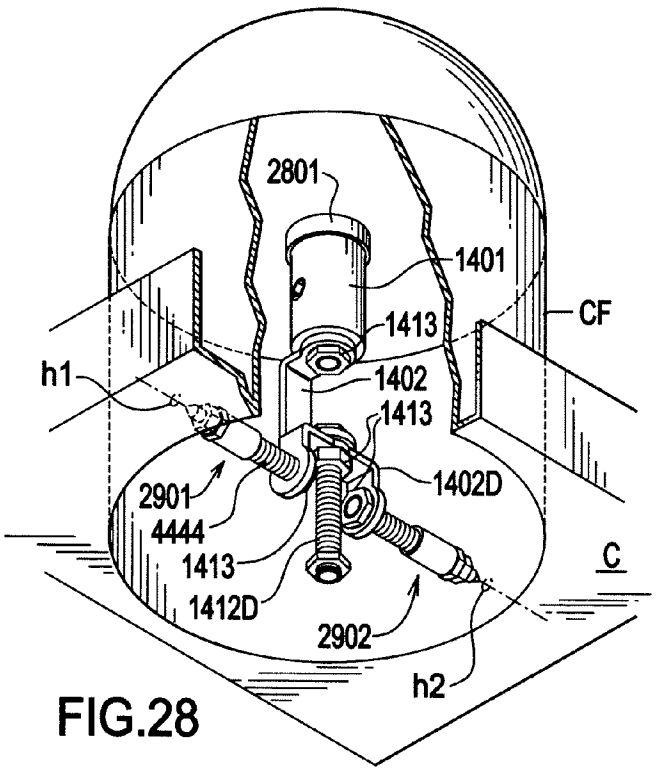
FIG. 28 is a bottom perspective view of a ceiling fan embodiment.

Referring last to FIGS. 28, 29, 30 a male adapter 1401 is supported by a prior art female socket 2801 of ceiling fixture CF. The hickey 1402 supports a second hickey 1402D in a down facing direction using nuts 1413 locking the all thread 1412D in place. All thread 1412D connects to the brackets in fan assembly F in a known manner, and the wiring is the same as assembly MALE 1 in FIG. 22.

A pair of support tip assemblies 2901, 2902 are supported by hickey 1402D and nuts 1413. Each support tip assembly consists of a base all thread segment 4444, a traveling coupler 4445, a locking nut 1413 for the coupler 4445, a support tip 4450, and locking nut 4451 for the support tip 4450.

The ceiling fixture CF is modified with holes h1, h2 which receive tips 4450. The couplers 4445 are hand tightened to secure tips 4450 in holes h1, h2. Thus, the fan support assembly FA can support over a hundred pounds of weight as tested, easily supporting the fan F.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. An extension adapter for a female electrical socket for a ceiling recessed lighting fixture, said extension adapter comprising:

a male adapter sized to thread into a female receptacle of the ceiling recessed lighting fixture;

a rigid U shaped bracket having an upper arm connected to a bottom of the male adapter;

said rigid U shaped bracket having a horizontal lower arm with a vertical mounting hole;

an all thread connected in the vertical mounting hole;

a strain relief supported below the lower arm of the bracket by the all thread;

a flexible cable supported by the strain relief; and a lamp supported from the flexible cable and wired to the male adapter.

2. The apparatus of claim 1 further comprising a ceiling cover supported by the flexible cable, wherein a hole in the ceiling recessed lighting fixture is covered by the ceiling cover.

3. The apparatus of claim 2 further comprising a ceiling canopy supported by the flexible cable.

4. The apparatus of claim 3, wherein a collar with a set screw provides the support from the flexible cable to the ceiling cover and the canopy.

5. The apparatus of claim 2, wherein the lamp supported by the flexible cable has a smaller sized bulb thread than the female receptacle of the ceiling recessed lighting fixture.

6. An extension adapter for a female electrical socket for a ceiling recessed lighting fixture, said extension adapter comprising:

a male adapter sized to thread into a female receptacle of the ceiling recessed lighting fixture;

a rigid U shaped bracket having an upper arm connected to a bottom of the male adapter;

said rigid U shaped bracket having a horizontal lower arm with a vertical mounting hole;

an all thread connected in the vertical mounting hole;

a rigid rod supported by the all thread; and a lamp supported from the rigid rod and wired to the male adapter.

7. The apparatus of claim 6, wherein the lamp further comprises a lamp shade supported by the rigid rod.

8. The apparatus of claim 6, wherein the rigid rod further comprises a plurality of rigid rod segments joined together by a plurality of all thread segments.

9. The apparatus of claim 6, wherein the lamp further comprises a shade, and the rigid rod supports a ceiling cover via a stopper.

* * * * *